US006254402B1

(12) United States Patent
Barnes, Jr. et al.

(10) Patent No.: US 6,254,402 B1
(45) Date of Patent: Jul. 3, 2001

(54) PUSH PIN GROUND

(75) Inventors: Richard Lewis Barnes, Jr., Unadilla; Gregory John Oleksik, Otego, both of NY (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 09/338,494

(22) Filed: Jun. 23, 1999

(51) Int. Cl.[7] ..... H01R 4/66
(52) U.S. Cl. ..... 439/95
(58) Field of Search ..... 439/95, 825, 620, 439/843, 92; 411/45; 408/229

(56) References Cited

U.S. PATENT DOCUMENTS

| | | | | |
|---|---|---|---|---|
| 2,410,618 | | 11/1946 | Zelov . | |
| 3,219,961 | * | 11/1965 | Bailey | 439/354 |
| 4,113,333 | | 9/1978 | Horowitz . | |
| 4,174,874 | | 11/1979 | Lee . | |
| 4,291,930 | | 9/1981 | Landgreen . | |
| 4,407,553 | | 10/1983 | Dvorachek et al. . | |
| 4,655,423 | * | 4/1987 | Schavilje | 248/71 |
| 4,946,400 | | 8/1990 | Kawai et al. . | |
| 4,983,127 | | 1/1991 | Kawai et al. . | |
| 5,258,015 | * | 11/1993 | Li | 606/232 |
| 5,573,411 | | 11/1996 | Bartosz et al. . | |

FOREIGN PATENT DOCUMENTS 0 449 737 10/1991 (EP) .

* cited by examiner

*Primary Examiner*—Gary F. Paumen
*Assistant Examiner*—Phuong Chi Nguyen
(74) *Attorney, Agent, or Firm*—Blank Rome Comisky & McCauley,LLP

(57) ABSTRACT

An electrical connector includes a shell, an insert arranged at least partially inside the shell, a contact supported by the insert, and a removable pin for connecting the contact to an inside surface of the shell. The connector is assembled by mounting the ground contact in the insert so that the a receiving hole in the insert is aligned with the pin receptacle on the ground contact. The pin is the slid through the pin receiving hole and into the pin receptacle before the shell is slid over the pin so that the pin abuts an inside surface of the shell and connects the contact to the shell.

17 Claims, 2 Drawing Sheets

PUSH PIN GROUND

BACKGROUND OF THE INVENTION

1. Field of the Invention

The present invention generally relates to electrical connectors, and more particularly to a connector having at least one contact grounded to the shell or housing of the connector.

2. Description of the Related Art

In many types of electrical connectors, it is desirable to provide grounding for one or more of the contacts directly to the shell of the connector. Such grounding is typically provided by using a screw to establish an electrical connection between the contact to be grounded and the shell of the connector. A hole is machined in the shell and in the insert that retains the contacts in the shell, and threads are tapped into the contact. Then the shell insert and contact are aligned and the screw inserted into the openings in the shell and insert, and threaded into the contact. Threading ensures engagement between the grounding contact and the screw, as well as between the head of the screw and the connector shell. Examples of this type of screw grounding arrangement are disclosed in U.S. Pat. Nos. 2,410,618, 4,113,333, 4,291,930, and 4,407,553.

There are several problems with the conventional screw-based grounding arrangement. First, the presence of an opening in the shell through which the screw is inserted may compromise the environmental sealing of the connector. Second, assembly of this type of connector is difficult because of the need to align holes in the insert and contact with the hole in the shell following insertion of the contact into the insert, and of the insert into the shell. Third, since the head of the screw is arranged on the outside surface of the shell, it can be inadvertently loosened so as to create a situation where the shell is not properly grounded.

An alternative arrangement that eliminates the need for a grounding screw is disclosed in U.S. Pat. No. 5,573,411. In the arrangement disclosed in this patent, a grounding wire contact pin is integrally formed with a grounding wire element that extends to the outer surface of an insert and forms an interference fit with an inside surface of the outer shell of the plug. While this arrangement eliminates the need for forming a screw hole in the outer shell of the plug, however, it has the disadvantage that it can only be used in situations where the contact pin and grounding element may be molded into the insert. Since the pin and grounding element are integrally formed inside the insert, they are difficult to manufacture with appropriate tolerances, greatly limiting applicability of this type of grounding arrangement. In addition, because the pin and grounding element are not molded into the insert, the entire insert assembly must be replaced if the contact or grounding element fails.

SUMMARY OF THE INVENTION

It is therefore a first objective of the invention to provide a grounding arrangement for an electrical connector which does not compromise environmental sealing of the connector, provides a secure electrical connection between the grounding contact and connector shell, and yet which is simple to assemble and requires only minor modifications to the conventional connector insert and grounding contact arrangements.

It is a second objective of the invention to provide a grounding arrangement for an electrical connector of the type in which contacts are held within the connector shell by an insulating insert, in which a grounding contact positioned in the insert is grounded to the shell, and yet in which alignment of an opening in the contact insert with an opening in the connector shell following insertion of the insert into the shell is not required.

It is a third objective of the invention to provide a grounding arrangement for an electrical connector which is not exposed to an outside of the connector shell an therefore not subject to inadvertent loosening.

It is a fourth objective of the invention to provide a grounding arrangement for an electrical connector in which a grounding pin extending from the contact to the shell is self-biased to ensure proper electrical continuity between the contact and the shell.

These and other objectives of the invention are achieved by providing a grounding arrangement for an electrical connector of the type including a shell, an insert arranged at least partially inside the shell, and a contact positioned at least partially within the insert, in which grounding to the shell is established by a pin or lug having one end arranged to engage the grounding contact, and which extends through an opening in the insert to engage an interior surface of the shell. Advantageously, the pin or lug is arranged such that, upon engagement of the shell-engaging end of the pin or lug with the interior of the shell, the pin or lug is self-biased against the grounding contact and shell without the need to screw or otherwise fixedly secure the grounding pin or lug to the contact and shell.

In an especially preferred embodiment of the invention, the grounding pin is conical or frusto-conical in shape and includes a convex head for abutting the inside surface of the shell, the shape of the head facilitating insertion of the insert and grounding pin into the connector shell. Opposite the convex head of the grounding pin of this embodiment are a plurality of flexible legs arranged to be received in a tapered hole in the grounding contact and which serve to bias the pin against the grounding contact in order to ensure electrical continuity between the shell, the pin, and the contact.

In an alternative embodiment of the invention, the pin is L-shaped, with a portion of the pin extending outwardly from the insert being bent generally transversely to the outside of the insert and slightly curved to resiliently engage the interior surface of the shell, and the opposite section of the pin including a slot arranged to fit over a portion of the grounding contact.

In addition to offering the advantages of preserving the environmental integrity of a connector in which the grounding arrangement is used, and of simplifying assembly, the grounding arrangement of the invention has the advantages that grounding of the ground contact to the shell is established upon insertion into the shell of the insert containing the ground contact, providing immediate grounding protection, and of being easily disassembled upon removal of the insert from the connector shell.

BRIEF DESCRIPTION OF THE DRAWINGS

The invention will now be described with respect to the following drawings wherein the numerals have been used to identify similar features in each of the figures, and wherein.

DETAILED DESCRIPTION OF THE PREFERRED EMBODIMENTS

Figure 1:
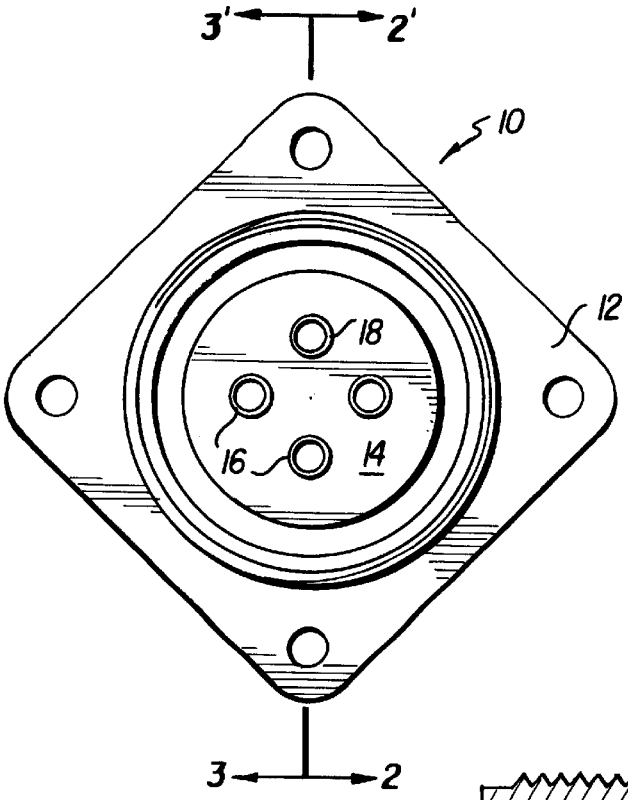
FIG. 1 is a front elevational view of an electrical connector constructed in accordance with the principles of a preferred embodiment of the invention.

FIG. 1 is a front view of an electrical connector 10 including a conductive, or metallic, shell 12 and an insulating, or non-metallic, insert 14 which supports a plurality of contacts 16. At least one of the contacts 16 is a ground contact which is electrically connected to the shell 12 as described in more detail below.

Although the contacts 16 are illustrated as being female contact pins, a variety of other contacts, including male contact pins, may also be used. In addition, those skilled in the art will appreciate that the exact configuration of the shell and insert may, like the configuration of the contacts, be varied in numerous ways without departing from the scope of the invention, and that while the invention is especially advantageous in the context of environmentally-sealed cylindrical connectors of the type illustrated, the invention may be used in connection with any connector having an insulative contact-holding insert and a shell to which a contact in the insert may be grounded.

Figure 2:
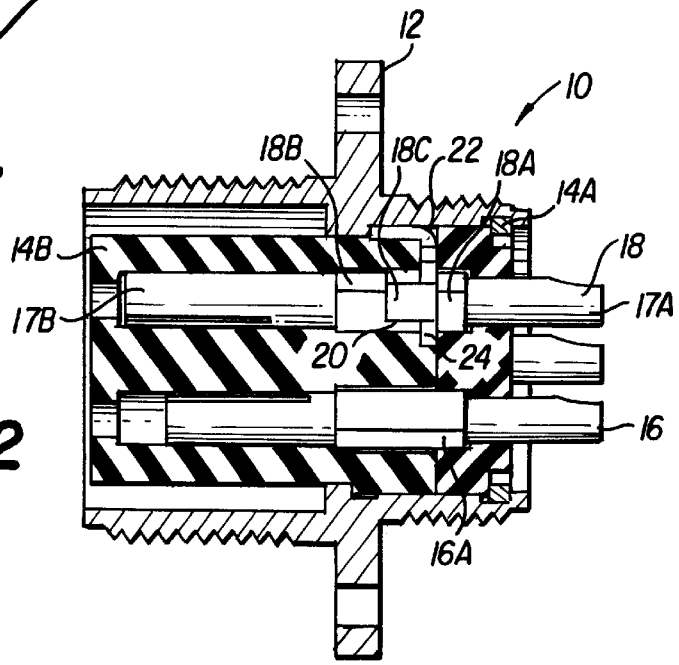
FIG. 2 is a cross-sectional view taken along section line 2–2' in FIG. 1.
Figure 3:
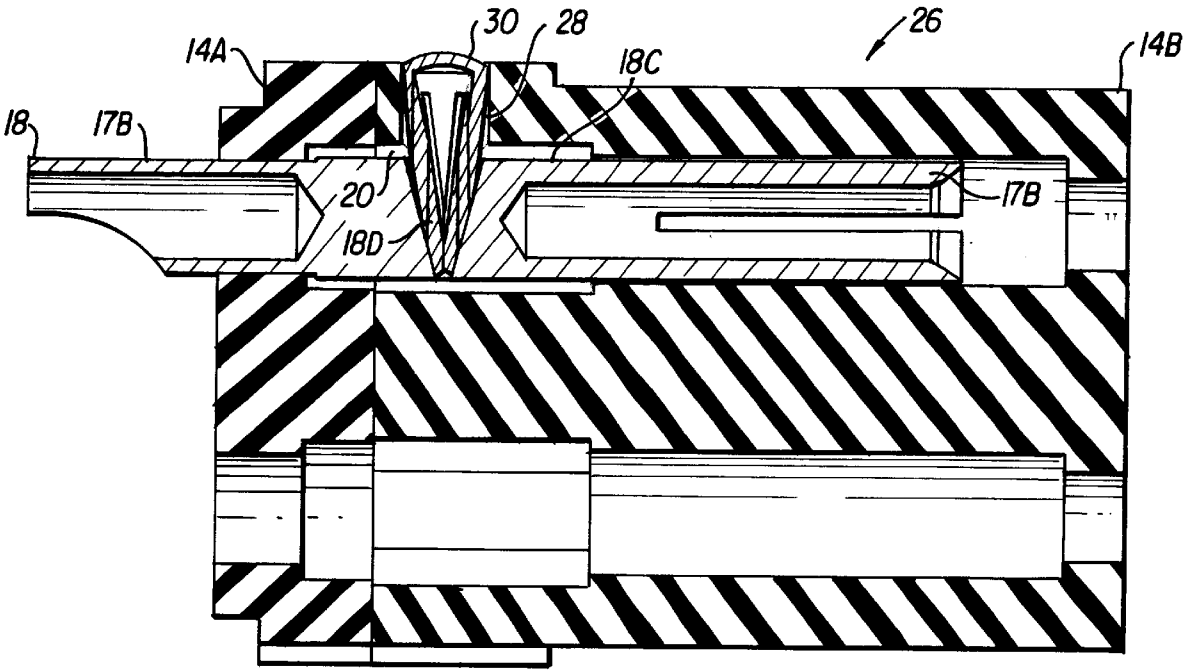
FIG. 3 is a sectional view, taken along section line 3—3' in FIG. 1, of an alternative embodiment of a ground contact, insert and pin subassembly for the electrical connector shown in FIG. 1.

FIGS. 2 and 3 show alternative embodiments of grounding pins according to the invention. As illustrated in these figures, the inserts 14 include a front element 14A and a rear element 14B which engage each side of a collar 16A on the contact 16. Other arrangements for holding the contacts within the insert 14, including molding the contacts in the insert, may also be used. Each contact includes mating ends 17A and 17B arranged to mate with or be terminated to other connector contacts, wires, or other conductors, and a pin receiving section 18C modified as described below to receive one end of the alternative grounding pins or lugs 24 and 30.

In the arrangement illustrated in FIG. 2, a pin receiving space 20 is formed between collar portions 18A and 18B of the ground contact 18. An L-shaped recess 22 is formed on the front and top sides of the rear insert element 14B for receiving an L-shaped pin 24. The pin extends through the front portion of the recess 22 into the pin receiving space 20 where it splits to form a leg on each side of the pin receiving section 18C of the ground contact 18. The bottom portion of the L-shaped pin 24 preferably includes an open-ended slot which conforms to the shape of the pin receiving section 18C of the ground contact 18.

In this configuration, the pin 24 is easily insertable into, and removable from, the recess 22 for connecting the ground contact 18 to the inside surface of the shell 12. During assembly, after the insert elements 14A and 14B have been slid over the ends of the contacts 16 and 18, the L-shaped pin 24 is simply slid, or dropped into, the recess 24. The pin 24 may have a substantially straight shape which is subsequently bent into position, trimmed, or otherwise sized to form a suitable electrical connection between the ground contact 18 and the inside surface of the shell 12. Preferably, the portion of the pin 24 extending along the outside of the insert is slightly curved or outwardly biased to ensure a good electrical connection to the shell, and also to bias the opposite end of the pin against the ground contact.

Those skilled in the art will appreciate that the exact manner in which the pin 24 is arranged to engage the interior surface of the connector shell, or the ground contact, maybe varied without departing from the basic principles of the invention. For example, instead of being slotted, pin 24 may also include an opening through which the pin receiving portion 18C of ground contact 18 is inserted after the pin has been positioned in the connector.

In the especially preferred embodiment illustrated in FIG. 3, the L-shaped pin of the embodiment of FIGS. 2 is replaced by a self-biased insert and pin subassembly 26, which may also be used with the electrical connector 10 shown in FIG. 1 but provide a more secure linear biasing force. In this embodiment, the ground contact 18 is provided with a pin receiving section 18C including a groove, slot, bracket, fitting, recess, hole, or other pin receptacle 18D which is preferably tapered in order to have a smaller diameter size at its lower end. The L-shaped recess 22 in the rear insert element 14B for the embodiment shown in FIG. 2 has been replaced in the embodiment shown in FIG. 3 with a pin receiving hole 28. A substantially straight pin 30 slides through the insert hole 28 and into the contact hole 18D for connecting the contact 18 to an inside surface of the shell (not shown in FIG. 3).

Figure 4:
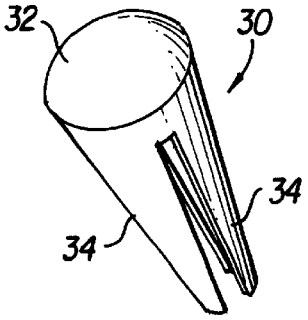
FIG. 4 is an isometric view of a pin.
Figure 5:
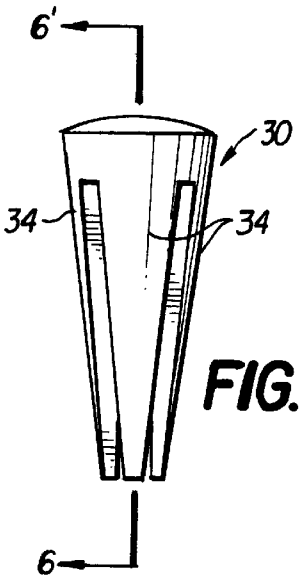
FIG. 5 is a side view of the pin in FIG. 4.
Figure 6:
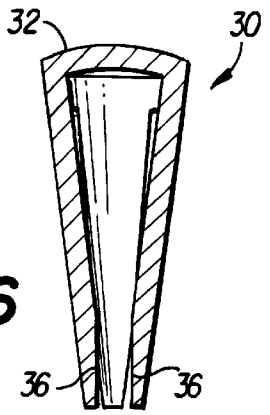
FIG. 6 is a sectional view taken along section line 6–6' in FIG. 5

As is best illustrated in FIGS. 4–6, the pin 30 preferably includes a convex head 32 for improving the connection to the inside surface of the shell and is conical, or frusto-conical, in shape. The length and conical shape of the pin 30 are chosen so that the tip of the pin 30 abuts the inside surface of the hole 18D so as to accurately position the pin vertically inside the hole 28 and receptacle 18D with the head 32 protruding slightly beyond the top surface of the insert 14. The pin may also be substantially cylindrical in shape and/or have other outside diameter shapes corresponding to the inside diameter of the holes 28 and/or pin receptacle 18D.

As shown in the figures the pin 30 is preferably hollow and includes a plurality of flexible legs 34 which contact the inside surface of the pin receptacle 18D in ground contact 18. Although the illustrated pin 30 includes four legs separated by rectangular slots, other numbers of legs and other leg spacing configurations may also be used. The legs 34 are preferably resilient so that the tail of the pin 30 is radially compressed as it is slid into the pin receptacle 8D, as shown in FIG. 3. Due in part to its frusto-conical shape, the ends of each of the legs 34 may be provided with narrowed inside walls 36 which are arranged to touch each other when the pin 30 is fully compressed into the tapered receptacle 18D. The narrowed inside walls 36 may also be provided with square corners on their inside surfaces (not shown) for helping to align the inside surfaces of the legs as they are compressed.

Once the pin 30 is slid, or otherwise inserted, through the pin receiving hole 28 and into the tapered receptacle 18D, the resilient legs 34 will press against the inside wall of the receptacle 18D to urge the head 32 toward the inside surface of the shell and thus ensure a good connection between the shell 12 and the ground contact 18. The pin 30 also helps prevent the contact 18 from sliding horizontally inside the insert 14. Consequently, the shoulders 18A and 18B in FIG. 2 are not required for the embodiment illustrated in FIG. 3. Since the pin 30 is not accessible from outside the fully assembled connector, the risk of inappropriate removal of the shell ground connection is significantly reduced.

Although two preferred embodiments of the invention have been described with sufficient particularity to enable a person skilled in the art to make and use the invention without undue experimentation, it will be appreciated that numerous other variations and modifications of the illustrated embodiments, in addition to those already noted above, may be made by those skilled in the art. Each of these variations and modifications, including those not specifically mentioned herein, is intended to be included within the scope of the invention, and thus the description of the invention and the illustrations thereof are not to be taken as limiting, but rather it is intended that the invention should be defined solely by the appended claims.

What is claimed is:

1. An electrical connector, comprising:

a shell;

an insert arranged at least partially inside the shell;

a contact positioned at least partially within the insert; and a removable pin for electrically connecting the contact to an inside surface of the shell; said pin being conical in shape and engaging the inside surface of the shell.

2. The electrical connector recited in claim 1, wherein said pin includes a convex head for abutting said inside surface of the shell.

3. The electrical connector recited in claim 1, wherein said pin is frusto-conical in shape.

4. The electrical connector recited in claim 1 wherein said pin includes a plurality of flexible legs.

5. The electrical connector recited in claim 1 wherein said contact also includes a hole for receiving a tail end of said pin.

6. The electrical connector recited in claim 5 wherein said connector hole is tapered.

7. The electrical connector recited in claim 6 wherein said pin includes a plurality of flexible legs.

8. An electrical connector, comprising:

a conductive shell;

a non-conductive insert arranged at least partially inside the shell;

an electrical contact at least partially positioned within the insert;

a hole formed in the insert extending from the contact to an inside surface of the shell;

said contact also having a receptacle aligned with said insert hole; and a slidable pin, extending through the insert hole and into said receptacle, for electrically connecting the contact to the inside surface of the shell; said pin being conical in shape and engaging the inside surface of the shell.

9. The electrical connector recited in claim 8 wherein said pin includes a convex head for abutting said inside surface of the shell.

10. The electrical connector recited in claim 9 wherein said pin is frusto-conical in shape.

11. The electrical connector recited in claim 9, wherein:

at least one of said insert hole and receptacle includes a tapered portion; and said pin includes a plurality of flexible legs for engaging an inside surface of the tapered portion and urging the pin toward an inside surface of the shell.

12. The electrical connector recited in claim 8, wherein said pin is frusto-conical in shape.

13. An electrical connector, comprising:

a conductive shell;

a non-conductive insert arranged at least partially inside the shell;

an electrical contact positioned at least partially within the insert;

a substantially cylindrical hole formed in the insert extending from the contact to an inside surface of the shell;

a substantially tapered hole formed through the contact and aligned with the insert hole;

a frusto-conical slidable pin having a convex head for abutting an inside surface of the shell and extending through the insert hole and at least partially into the contact hole for connecting the pin to the contact.

14. The electrical connector recited in claim 13 wherein said pin includes a plurality of flexible legs for abutting an inside surface of said tapered hole and urging the pin against the inside surface of the shell.

15. The electrical connector recited in claim 14 wherein said pin is substantially hollow.

16. The electrical connector recited in claim 15 wherein a free end of each leg of said pin includes narrowed inside walls.

17. A method of assembling an electrical connector including a pin, ground contact with a pin receptacle, an insert with a pin receiving hole, and a shell, the method comprising:

mounting the ground contact in the insert so that the pin receiving hole is aligned with the pin receptacle;

sliding the pin through the pin receiving hole and into the pin receptacle;

sliding the shell over the pin in the receiving hole so that the pin abuts an inside surface of the shell.

* * * * *